US006561109B1

(12) United States Patent
La Muraglia

(10) Patent No.: US 6,561,109 B1
(45) Date of Patent: May 13, 2003

(54) SAILING BOAT FOR TEACHING AND FOR DISABLED PEOPLE

(76) Inventor: Riccardo La Muraglia, via della Pisana 1439, 00163 Roma (IT)

( * ) Notice: Subject to any disclaimer, the term of this patent is extended or adjusted under 35 U.S.C. 154(b) by 0 days.

(21) Appl. No.: 09/869,193

(22) PCT Filed: Mar. 6, 2000

(86) PCT No.: PCT/IT00/00073

§ 371 (c)(1),
(2), (4) Date: Jun. 25, 2001

(87) PCT Pub. No.: WO01/30649

PCT Pub. Date: May 3, 2001

(30) Foreign Application Priority Data

Oct. 25, 1999 (IT) ..... RM99A0654

(51) Int. Cl.[7] ..... B63B 35/00
(52) U.S. Cl. ..... 114/39.21; 114/363
(58) Field of Search ..... 114/39.11, 39.21, 114/39.25

(56) References Cited

U.S. PATENT DOCUMENTS

| | | | | |
|---|---|---|---|---|
| 3,291,088 A | * | 12/1966 | Klose | 114/138 |
| 3,922,994 A | | 12/1975 | De Long | |
| 4,314,518 A | * | 2/1982 | Marsden | 114/144 C |
| 5,582,126 A | * | 12/1996 | Rypinski | 114/352 |

FOREIGN PATENT DOCUMENTS

| | | |
|---|---|---|
| DE | 43 18 001 A1 | 1/1994 |
| GB | 157814 | 10/1921 |
| WO | WO 99/11519 | 3/1999 |

* cited by examiner

*Primary Examiner*—Jesus D. Sotelo
(74) *Attorney, Agent, or Firm*—Young & Thompson

(57) ABSTRACT

A structure of a sailing boat that allows disabled people to learn how to sail and perform without any danger all maneuvers performed on the great competition sailing boats, consists of a multiple housing (1) realized in the boat (BV), provided with two seats (2, 3) placed in succession, so that a teacher, sitting on the back seat, may check, suggest and correct the maneuvers performed by a disabled person or by a youngster sitting on the front seat, and who may work only with his arms.

3 Claims, 1 Drawing Sheet

SAILING BOAT FOR TEACHING AND FOR DISABLED PEOPLE

BACKGROUND OF THE INVENTION

The present invention concerns a new structure of a sailing boat that allows disabled people to learn how to sail, and to learn how to perform, without any danger, the same maneuvers done on the great competition sailing boats. Furthermore, the structure according to the present invention has proved to be suitable for instructing beginners, specially youngsters.

It is well known that until today all those people that are disabled at their legs—even if they are able to use their arms—have been kept away from the marvellous world of sailing due to a total lack of floating means equipped and structured in such a way as to allow the presence and the cooperation of the disable person accompanied by a teacher.

SUMMARY OF THE INVENTION

Said lack is completely solved by means of the structure of sailing boat according to the present invention, consisting of a multiple housing realized in the boat and provided with two seats in succession so that a teacher, sitting on the back seat, may check, suggest and correct the maneuvers performed by a disabled person or by a young person sitting on the front seat, and who may work only with his arms.

The main feature of the structure according to the present invention consists in that it provides for important social and sports functions which have never before been faced and solved by any existing floating means or sailing boat.

BRIEF DESCRIPTION OF THE DRAWINGS

The present invention will be described more in detail hereinbelow relating to the enclosed drawings in which an embodiment is shown.

DESCRIPTION OF THE PREFERRED EMBODIMENTS

Figure 1:
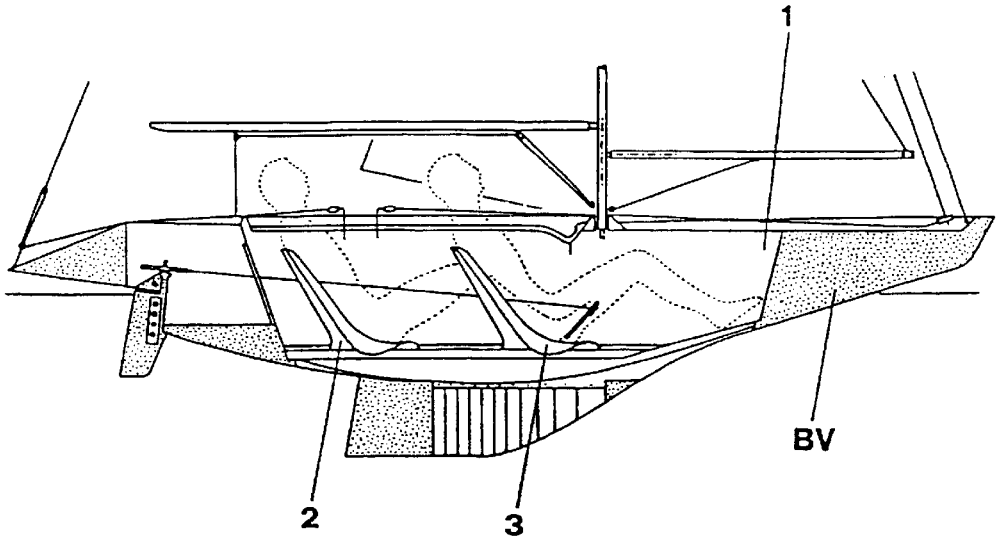
FIG. 1 shows a lateral, transparent scheme of a structure of a sailing boat for didactics and for disabled people, according to the present invention.
Figure 2:
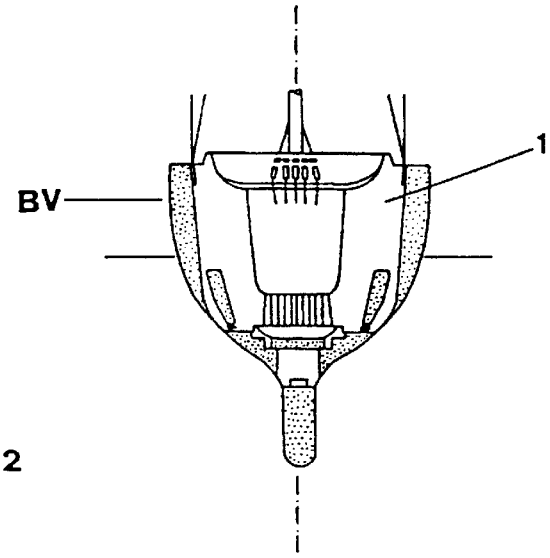
FIG. 2 shows a scheme of a section normal to the longitudinal line of the boat.

The enclosed figures show the structure of a sailing boat for didactics and for disabled people, comprising a multiple housing 1, realized in the hull of the boat BV, in which the seats 2, 3 are placed in succession, both in correspondence of the terminals for the control of the sail and of the rudder, so that a teacher may accompany and teach a disabled person or a youngster without any danger.

The advantages deriving from the present invention are many and considerable:

- the two seats allow, besides the safeness of a companion, also the possibility of hosting a teacher who may teach the beginner all manoeuvres for sailing, thus giving all disabled people, without any distinction of age and sex, the possibility of savouring the satisfactions and emotions of this sport;
- greatest safeness: the hull is practically unsinkable due to the double cofferdam filled up with high density plastic foam;
- a drift with 160 kg of lead lumps avoids any possibility of capsizing;
- the sports efficiency corresponds to the one of a great sailing-race boat: infact, besides the spanker and the "genova" staysail, the boat may also be provided with a spinnaker of wide surface;
- the structure is easy to transport, due to its weight and to its very contained dimensions.

What is claimed is:

1. A sailboat for instructing and for disabled people, comprising:

- a hull with a cockpit and a weighted keel below said cockpit;
- a mast extending from said hull;
- two tandem seats within said cockpit and aft of said mast, a forward one of said tandem seats being spaced from an interior side of said cockpit and from an aft one of said tandem seats so that a foot of a person in said aft seat can be placed abeam said forward seat;
- a rudder at a stern of said hull; and
- a control pedal in said cockpit for moving said rudder, said control pedal being abeam said forward seat and arranged so as to be operable by a hand of a person in said forward seat and by the foot of the person in said aft seat.

2. The sailboat of claim 1, wherein said control pedal is below a waterline of the sailboat when the sailboat is afloat and carrying two people.

3. The sailboat of claim 2, wherein each of said tandem seats has a bench and a backrest, wherein each said bench and most of each said backrest are below the waterline.

* * * * *